US010857413B2

(12) United States Patent
Hetrick et al.

(10) Patent No.: US 10,857,413 B2
(45) **Date of Patent: *Dec. 8, 2020**

(54) APPARATUS, KIT, AND METHOD FOR PERFORMING STRAP-BASED EXERCISES

(71) Applicant: Fitness Anywhere LLC, San Francisco, CA (US)

(72) Inventors: Randal Hetrick, San Francisco, CA (US); Mauricio Hernan Delgado, San Anselmo, CA (US)

(73) Assignee: Fitness Anywhere LLC, San Francisco, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/204,044

(22) Filed: Nov. 29, 2018

(65) Prior Publication Data

US 2019/0091507 A1 Mar. 28, 2019

Related U.S. Application Data

(63) Continuation of application No. 15/359,176, filed on Nov. 22, 2016, now Pat. No. 10,245,460.

(51) Int. Cl.
*A63B 21/068* (2006.01)
*A63B 21/00* (2006.01)
(Continued)

(52) U.S. Cl.
CPC ..... *A63B 21/068* (2013.01); *A63B 21/0023* (2013.01); *A63B 21/04* (2013.01); *A63B 21/151* (2013.01); *A63B 21/1663* (2013.01); *A63B 21/4019* (2015.10); *A63B 21/4023* (2015.10); *A63B 21/4035* (2015.10); *A63B 21/4043* (2015.10); *A63B 21/4034* (2015.10); *A63B 2225/09* (2013.01)

(58) Field of Classification Search
CPC ... A63B 21/068; A63B 21/08; A63B 21/4035; A63B 2225/09
See application file for complete search history.

(56) References Cited

U.S. PATENT DOCUMENTS 4,015,762 A 4/1977 Mendillo
4,909,505 A 3/1990 Tee
(Continued)

FOREIGN PATENT DOCUMENTS

DE 102014009392 A1 12/2015
WO 2012071061 A1 5/2012

OTHER PUBLICATIONS

Patent Cooperation Treaty International Search Report for PCT/US2017/063062 dated Feb. 21, 2018.

*Primary Examiner* — Andrew S Lo
(74) *Attorney, Agent, or Firm* — Duane Morris LLP

(57) ABSTRACT

The present disclosure relates to a modular strap-based exercise apparatus, kit, and method of use thereof, and more particularly to an apparatus, kit, and method for modularly connecting components of a strap-based exercise device. In an embodiment, the strap-based exercise apparatus includes one or more infinity loops configured to attach various portions of the exercise apparatus together. The exercise apparatus may be provided as a kit including an elongated member, a grip assembly, and one or more mechanisms for adjusting the length of a strap and connecting straps together.

11 Claims, 7 Drawing Sheets

(51) Int. Cl.

| | |
|---|---|
| ***A63B 21/002*** | (2006.01) |
| ***A63B 21/04*** | (2006.01) |
| ***A63B 21/16*** | (2006.01) |

(56) References Cited

U.S. PATENT DOCUMENTS

| | | | | |
|---|---|---|---|---|
| 5,518,486 | A | 5/1996 | Sheeler | |
| 5,888,180 | A * | 3/1999 | Dewberry | A63B 21/4019 2/161.1 |
| 5,997,494 | A * | 12/1999 | Watkins | A61F 5/04 482/105 |
| 6,368,255 | B1 * | 4/2002 | Chan-Rouse | A63B 23/00 482/126 |
| 6,729,268 | B1 | 5/2004 | Costell | |
| 7,044,896 | B2 | 5/2006 | Hetrick | |
| 8,038,584 | B1 | 10/2011 | Pruessner | |
| 2008/0132392 | A1 | 6/2008 | Moulton | |
| 2012/0322626 | A1 * | 12/2012 | Meimaroglou | A63B 23/03541 482/92 |
| 2012/0329620 | A1 * | 12/2012 | White | A63B 21/151 482/131 |
| 2013/0005544 | A1 * | 1/2013 | Butler | A63B 7/02 482/139 |
| 2013/0157821 | A1 * | 6/2013 | Crowell | A63B 21/0442 482/129 |
| 2013/0178345 | A1 * | 7/2013 | Wu | A63B 21/068 482/139 |
| 2014/0082891 | A1 * | 3/2014 | Hetrick | A44B 11/2557 24/115 H |
| 2014/0274569 | A1 * | 9/2014 | Lewen | A63B 7/02 482/24 |
| 2014/0274613 | A1 * | 9/2014 | DeMarco | A63B 21/068 482/139 |
| 2015/0165254 | A1 * | 6/2015 | Davis | A63B 21/068 482/23 |
| 2016/0030795 | A1 | 2/2016 | Rawlins | |
| 2016/0236026 | A1 * | 8/2016 | Hauptmann | A63B 21/0442 |
| 2017/0050071 | A1 * | 2/2017 | DeMarco | A63B 1/00 |
| 2017/0182344 | A1 * | 6/2017 | Foster | A63B 21/0023 |
| 2017/0225024 | A1 * | 8/2017 | Thrasher-Rudd | A63B 7/00 |

* cited by examiner

APPARATUS, KIT, AND METHOD FOR PERFORMING STRAP-BASED EXERCISES

PRIORITY CLAIM

This application is a continuation of U.S. patent application Ser. No. 15/359,176 APPARATUS, KIT, AND METHOD FOR PERFORMING STRAP-BASED EXERCISES, filed on Nov. 22, 2016 which is fully incorporated herein by reference.

FIELD OF THE DISCLOSURE

The present invention generally relates to a modular strap-based exercise apparatus and method, and more particularly to an apparatus and method for modularly connecting components of a strap-based exercise device.

BACKGROUND

The present disclosure generally relates to exercise devices, and in particular to a modular exercise device having one or more inelastic straps that is easily configurable for use in performing different exercises in a wide variety of environments.

Resistance exercise devices enable a user to exercise by providing resistance to the movement of a user's body. For example, a resistance exercise device may employ an individual's own bodyweight or allow a user to work one muscle against another by providing resistance to the movement of the user's arms, legs, or torso. Resistance exercise devices typically include either elastic bands or inelastic straps.

Often, resistance exercise devices are configured to attach to a support structure, such as a door, an attachment point on a ceiling, or a specially constructed metal truss. However, such resistance exercise devices often are incapable of working with a wide variety of structures, and thus different devices must be used with each type of support structure. Further, due to differences in height, weight, and/or strength between different users, it may not be possible for a single user to use a single device for a variety of exercises or for different users to use a single device for the same exercise. Accordingly, resistance exercise devices are generally usable for only a limited number of exercises or in only a limited number of circumstances. This requires users to purchase, maintain, and utilize a wide range of resistance exercise devices to perform multiple exercises or to use with different types of support structures.

There is a need to provide a resistance exercise device that is capable of being used for a complete workout for any user, including adjustments that allow a wide range of stances and exercises, and that provides resistance to the user's motion in a form that is useful for exercising. Further, there is a need for a modular resistance exercise device that offers the strength and reliability required by users, while simultaneously being economical to manufacture and not adversely affecting the size and weight of the device. As such, there is a particular need for an improved apparatus and method for connecting portions of a resistance exercise device (such as, for example, straps) together into a number of different configurations.

SUMMARY

The presently described apparatus and method overcome the disadvantages of the prior art by providing a novel resistance exercise system.

In accordance with one embodiment of the presently claimed invention, a modular strap-based exercise device is provided, along with a method for configuring such a device and attaching components thereof.

In accordance with an embodiment of the presently claimed invention, an inelastic exercise device is provided comprising:

an elongated member having a pair of ends separated by a length;

a first loop formed by folding a first portion of said elongated member against a second portion of said elongated member, wherein said second portion of said elongated member is proximate to said first portion of said elongated member;

a second loop formed by folding a third portion of said elongated member against said second portion of said elongated member, wherein the third portion of said elongated member is proximate to said second portion of said elongated member and said second loop is proximate to said first loop;

wherein said second portion of said elongated member is secured to said first portion of said elongated member and said third portion of said elongated member.

BRIEF DESCRIPTION OF THE DRAWINGS

The following disclosure as a whole may be best understood by reference to the provided detailed description when read in conjunction with the accompanying drawings, drawing descriptions, abstract, background, field of the disclosure, and associated headings. Identical reference numerals, when found on different figures, identify the same elements or functionally equivalent elements. The elements listed in the abstract are not referenced but nevertheless refer by association to the elements of the detailed description and associated disclosure.

DETAILED DESCRIPTION

The present disclosure is not limited to the particular details of the apparatus depicted, and other modifications and applications may be contemplated. Further changes may be made in the apparatus, device, or methods without departing from the true spirit and scope of the disclosure herein involved. It is intended, therefore, that the subject matter in this disclosure should be interpreted as illustrative, not in a limiting sense.

For purposes of contrasting various embodiments with the prior art, certain aspects and advantages of these embodiments are described where appropriate herein. Of course, it is to be understood that not necessarily all such aspects or advantages may be achieved in accordance with any particular embodiment. Modifications and variations can be made by one skilled in the art without departing from the spirit and scope of the invention including, but not limited to: the use of inelastic members, which are described herein as straps, that are round or have some other cross-sectional shape, and/or which are formed from two or more members joined together, as by stitching or with an adhesive; or the use of different mechanisms for adjusting the length of inelastic member that are known in the field including, but not limited to, buckles, hooks, or winding the inelastic member about a rigid element. Moreover, any one or more features of any embodiment may be combined with any one or more other features of any other embodiment, without departing from the scope of the invention.

Disclosed herein is a modular exercise device that is configured to be supported by, or that is configured to be easily attached to, a variety of supporting structures in a variety of configurations. The modular exercise device allows a user to perform a large number of exercises by easily adjusting the configuration of the device and the length of various portions of the device so as to provide resistance to the user's body.

In order to better understand the presently disclosed modular resistance exercise device, two exemplary prior art resistance exercise devices are generally described below and with reference to FIGS. 1-4, which are taken from U.S. Pat. No. 7,044,896 (the disclosure of which is incorporated herein by reference).

Figure 1:
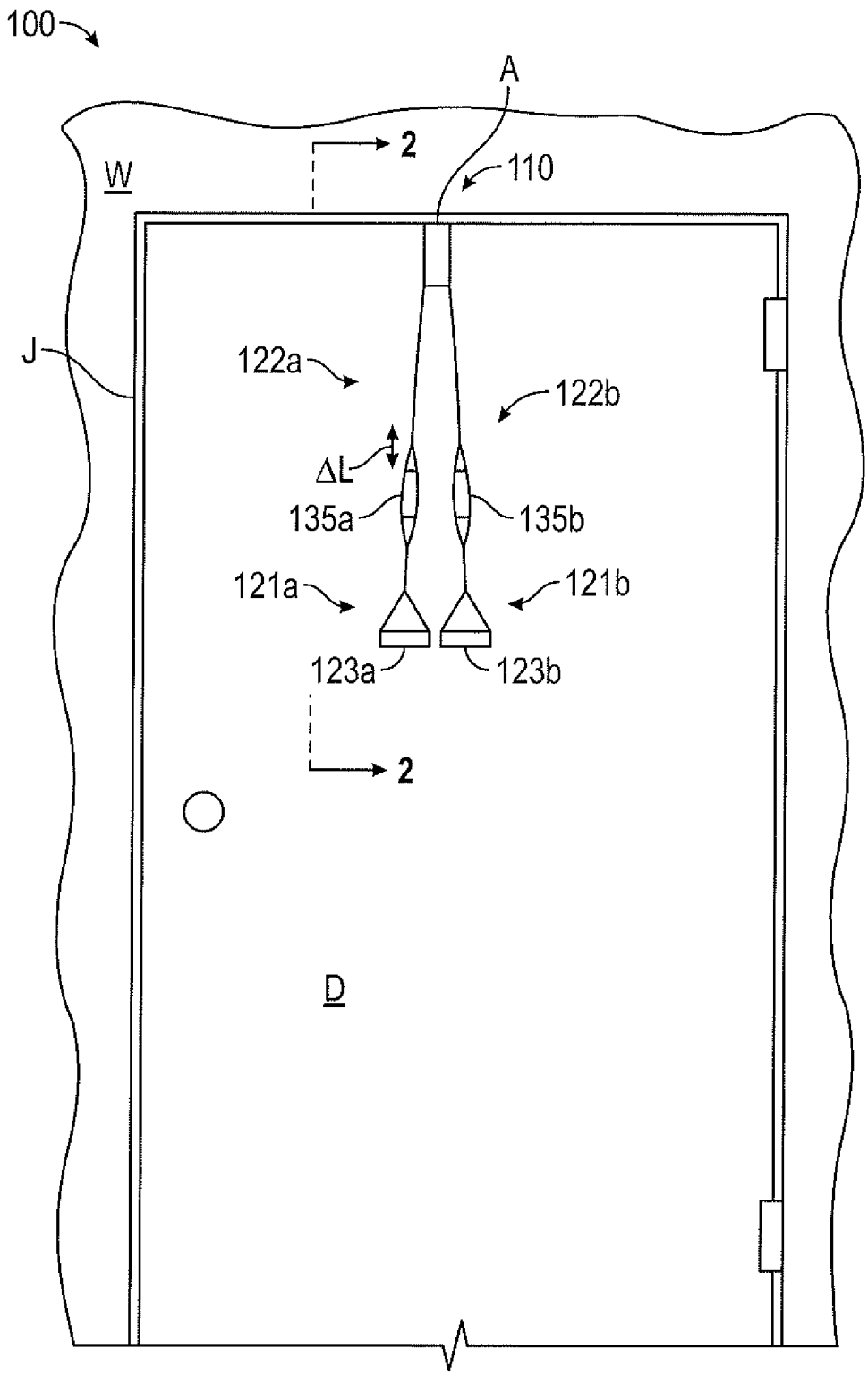
FIG. 1 is a schematic front view of a prior art exercise device as anchored between a door and door jamb.
Figure 2:
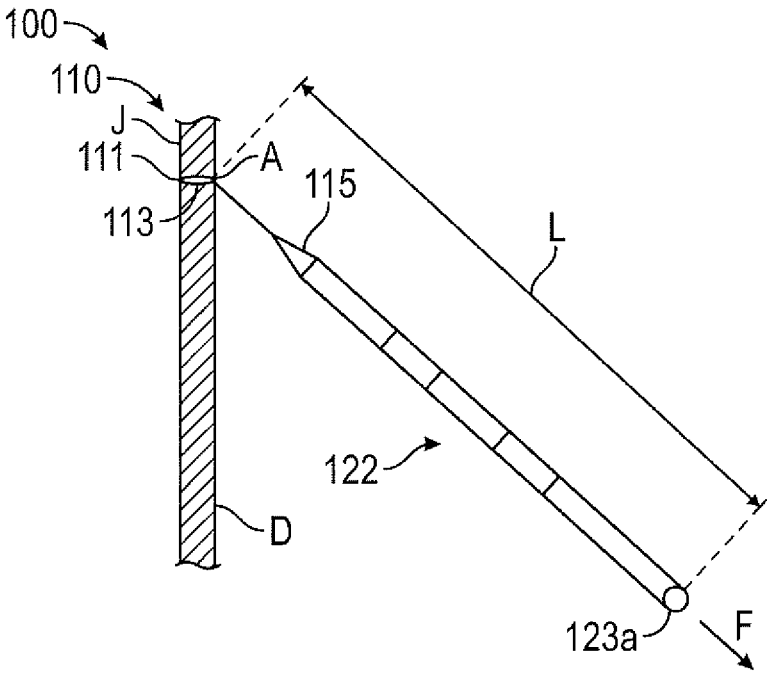
FIG. 2 is a partial schematic sectional view 2-2 of FIG. 1, showing the exercise device anchored between a door and door jamb.
Figure 3:
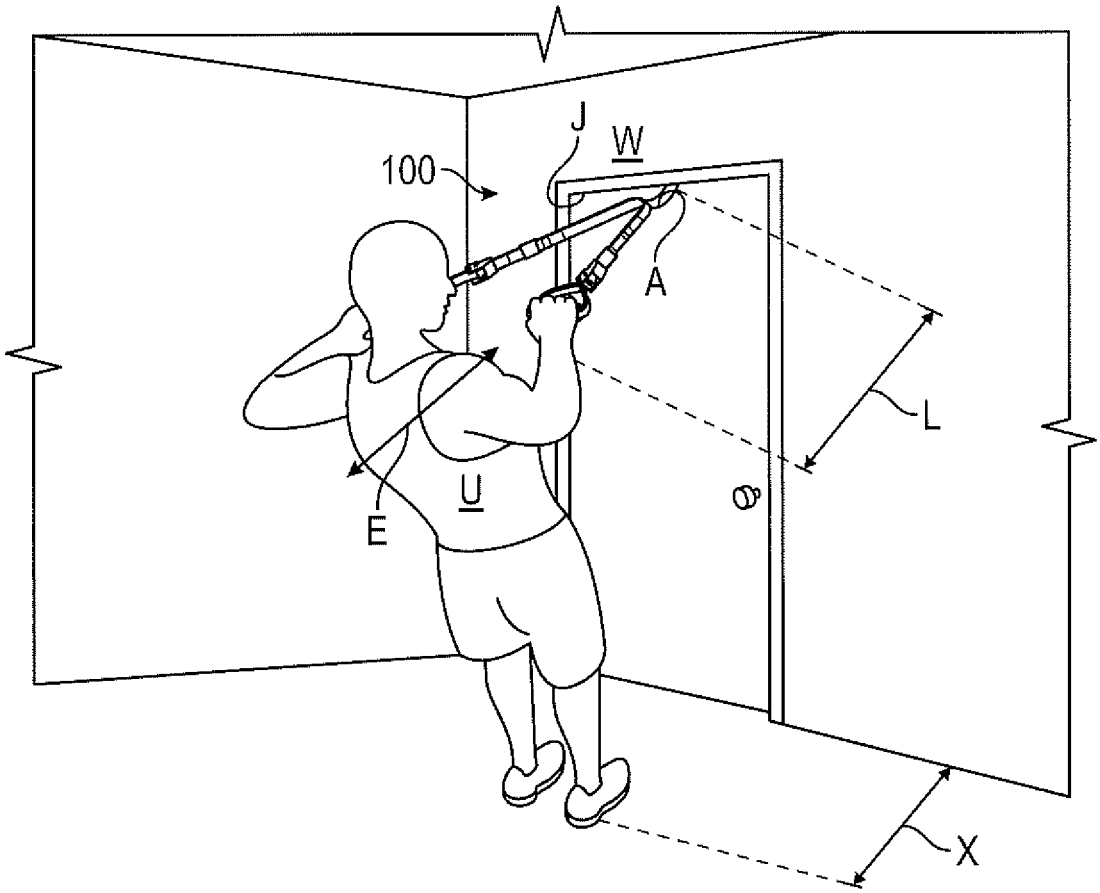
FIG. 3 is illustrative of a user performing a high row exercise with the exercise device of FIG. 1.

FIGS. 1-3 provide an illustrative overview of a resistance exercise device 100. As shown in the schematic view of FIG. 1, the exercise device 100 may be anchored at a point A between a door D and door jamb J. FIG. 2 is a partial sectional view 2-2 of FIG. 1, taken through door D and showing exercise device 100 in profile. FIG. 3 is illustrative of a user U exercising with the exercise device of FIG. 1.

Exercise device 100 includes an anchor 110 and a pair of elongated members 122, indicated as a first elongated member 122*a* and a second elongated member 122*b*, on either side of the anchor, as shown schematically in FIGS. 1 and 2. Each of the pair of elongated members 122 has a corresponding lengthening mechanism 135 (also referred to herein as a strap length adjustment mechanism), indicated as mechanism 135*a* and 135*b*. A pair of grips 123 is provided, with one positioned at each end 121, shown as end 121*a* and 121*b* of each arm 122, specifically first arm 122*a* has a first grip 123*a*, and second arm 122*b* has a second grip 123*b*. Each arm 122 is substantially inelastic and flexible with an adjustable length L between a corresponding one of the pair of grips 123 and anchor 110. The length of each arm 122 is adjustable by use of the corresponding lengthening mechanisms 135, as indicated by double arrows ΔL As used herein, the noun "grip" encompasses any device that is interlockable with part of the human body, that is, any device that can be connected in such a way that a person can transfer a force to the grip, preferably a force equal to some or all of the person's body weight. As used, the verb "grip" refers to the action of interlocking such a device and a body part. When used in an exercise device, a grip is attached to other elements that permit the force to be transferred to another object, including but not limited to a stationary support, a device that can store or release energy (such as an elastic cord or a spring), or another body part. Grips include devices that can be surrounded by a body part—for example, a flexible loop or a hook—or that a body part can surround—such as an elongated member that can fit within the grasp of a user's hand. In this context, a member that can be gripped, or is grippable, is one that can either surround a body part or be surrounded by a body part and has a size and configuration that permits the transfer of force from the user to the grip. A "hand grip" is a grip that is sized for grasping by the hand, a "foot grip" is a grip that is sized for grasping a foot, and a "finger grip" is a grip that is sized for grasping by one or more of a user's fingers.

Anchor 110 provides support for elongated member 120 while still permitting some amount of movement. Specifically, the interaction of anchor 110 and elongated member 120 allows the elongated member 120 to be positioned on the anchor 110, and may also provide resistance to the movement of the elongated member 120 along the anchor 110. Preferably, the resistance is sufficient so that, under some circumstances, the support prevents movement of elongated member 120 along anchor 110, even where there is some mismatch of forces on the ends of the elongated member 120. In this way exercise device 100 may be used for a variety of exercises, for example by changing the length of elongated member 120, for example, and also provide an exercise device that can provide support for the user while exercising.

One type of support is referred to herein, without limitation, as a "frictional support." Anchors that provide frictional support include, but are not limited to, an element or portion of an element that can support elongated member 120 during exercising, and over which the elongated member 120 can slide. Resistance to the movement of elongated member 120 over anchor 110 may be determined, in part, by the frictional resistance of the elongated member 120 sliding over the anchor 110. For example, elongated member 120 may be configured to slide along anchor 110 while a user positions him or herself. During exercising, a slight mismatch in the pulling forces on the grips 123 is matched by static friction of the frictional support, and the grips 123 do not move while exercising. That is, the static friction between elongated member 120 and anchor 110 generated by the frictional support is sufficient to permit exercises in which elongated member 120 does not slide through anchor 110 while exercising. Means that provide frictional support include elements or portions of elements that form part of or which are attached to an anchor and which can support an elongated member (that may, for example, include grips) and which can allow the elongated member to slide along the supporting anchor and provide frictional resistance to the motion of the elongated member during exercising.

Anchor 110 is used to provide a fixed anchor point for exercise device 100 and to support a user's weight as it is applied to elongated members 122 as indicated by an arrow F in FIG. 2 and as shown in FIG. 3. As shown in FIG. 2, anchor 110 is adapted for positioning exercise device 100 in a door and providing support to elongated members 122 by having an enlarged portion 111, an elongated member 113 that can be a strap or cord, and an attachment 115 for supporting the elongated members by the anchor. With enlarged portion 111 on the opposite side of door D from elongated members 122, anchor 110 supports the weight of a user as grips 123 are pulled. The length of each of elongated member 122 can be easily adjusted through each lengthening mechanism 135. FIG. 2 shows arms 122 each having a length L.

In one embodiment, the length L is adjustable over a length that allows for a wide range of exercises. Thus, for example and without limitation, length L can be varied in length from approximately 3 feet to 6 feet. In another embodiment, elongated member 122 has a width of approximately 1.5 inches.

When supported by a structure, such as door D (as shown, for example, in FIGS. 1-3) the exercise device provides a pair of grips for a user to exercise against his or her weight according the user's position relative to the device, and provides for easily adjusting the length of the device. The device can be used to exercise in any one of a large number of orientations according to the selected adjustable length and according to where and how the user stands relative to the exercise device. In general, a user sets the exercise device to a desired length, positions himself or herself on the ground near the exercise device, supports a portion of his or her body weight from the exercise device by his or her hands or feet, and exercises by moving his or her body with his or her weight supported by the ground and the exercise device. Examples of support on the ground and exercise device include, but are not limited to, standing on one or both legs, lying on the stomach or the back, kneeling, or by having the hands on the ground, and having the exercise device support one's weight by the hands or feet, as appropriate.

In an alternative embodiment (not shown), elongated members 122 do not include lengthening mechanisms 135. In this embodiment, elongated members 122 are thus substantially inelastic and have a fixed length L between the pair of grips 123.

With reference to FIG. 3, a user U is shown in one of the many exercise positions, in particular a high row exercise, gripping the pair of grips 123 with the user's hands and having the user's feet placed a horizontal distance X from anchor point A. When anchored to a door, it is preferred that anchor point A is on the inwards side of the door (that is, that the door open away from user U) so that jamb J can support the user's weight. The user U is shown leaning away from anchor point A and supporting a fraction of his or her weight through device 100. It is apparent that user U can vary the amount of supported weight, and thus the resistance of exercise device 100, by adjustment of his or her stance relative to anchor point A (distance X) and the length of arms 122 (length L). The user U of FIG. 3 performs a high row exercise by moving his body in a direction E towards and away from anchor point A. Note that other exercises are also possible with the user in this position, for example by the user moving in other directions with the user's weight supported by the ground and exercise device 100.

Figure 4:
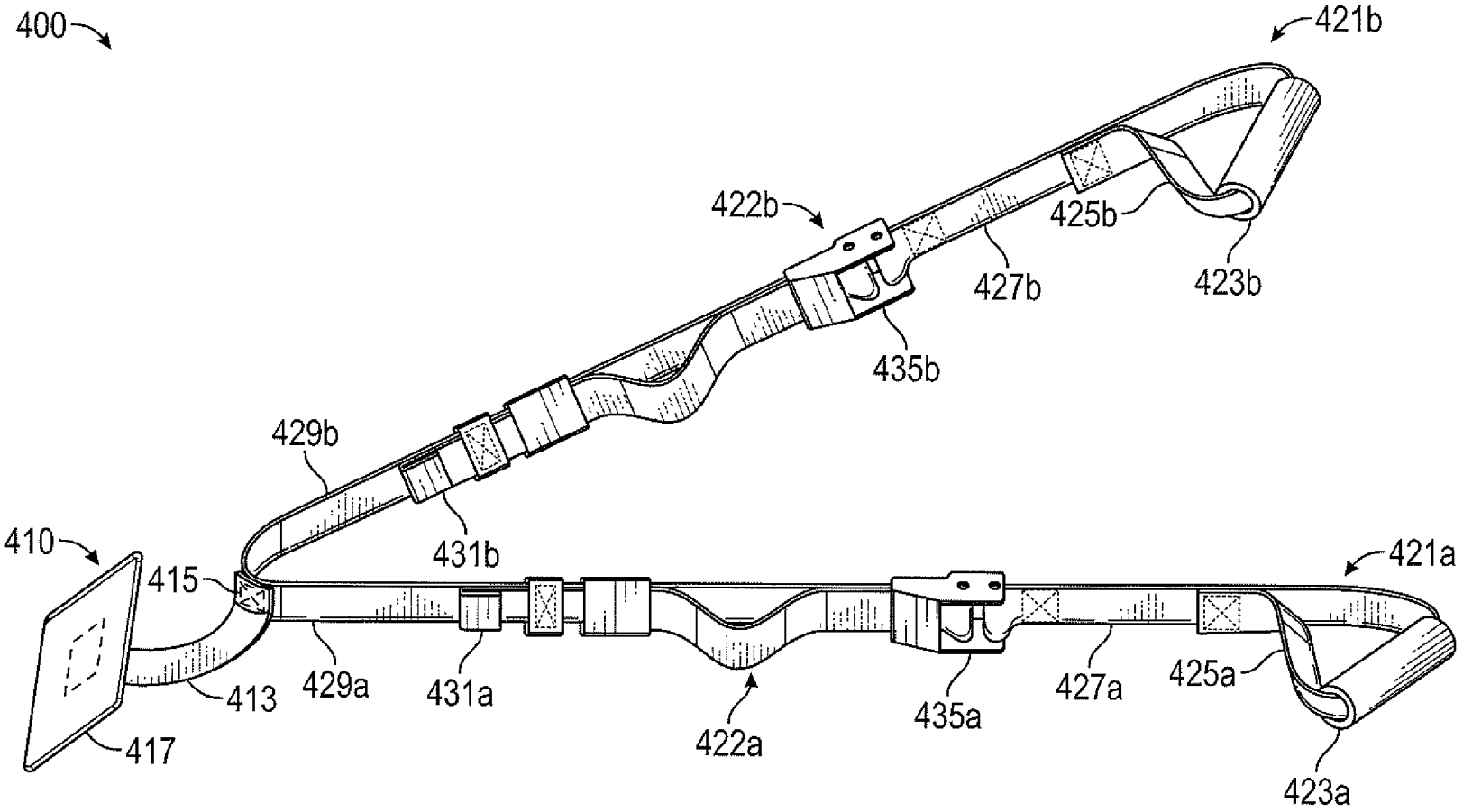
FIG. 4 is a perspective view of another prior art exercise device.

FIG. 4 provides a perspective view of another exercise device 400 which includes an anchor 410 and a pair of elongated members 422. Exercise device 400, anchor 410, and elongated members 422 are generally similar to exercise device 100, anchor 110, and elongated members 122, respectively, except further detailed below. Where possible, similar elements are identified with identical reference numerals in FIGS. 1-4.

Anchor 410 includes a substantially inelastic, flexible elongated member 413 having an enlarged first end 411 that is wider than the strap, and a second end at attachment 415. Throughout this disclosure, the terms "substantially inelastic" or "inelastic" are used to refer to an element that does not stretch more than 10% during use. As is understood by one of skill in the art, a degree of elasticity is inherent to most materials, particularly when they experience significant loading. Anchor 410 supports each of a pair of elongated members 422, indicated as elongated members 422*a* and 422*b* at attachment 415. Each elongated member 422 has a respective end 421, shown as end 421*a* and 421*b*, each forming a loop 425, shown as loop 425*a* and 425*b*, to support one of a pair of grips 423, shown as grip 423*a* and 423*b*. Each elongated member 422 also includes a pair of lengthening mechanisms 435, shown without limitation, as buckle 435*a* and 435*b*. In addition, each elongated member 422 includes a member 429, shown as members 429*a* and 429*b*, that is sewn to strap 414 at attachment 415.

As noted previously, anchor 410 includes an inelastic, flexible elongated member 413. In one embodiment, the majority of lengths of anchor 410 and elongated members 422 are formed of materials that include, but are not limited to, straps of a webbing of a natural or synthetic material having strength sufficient to support the weight of a device user. Webbing materials include, but are not limited to, one or more of a nylon, polypropylene or other polymeric fibers. It is to be understood that a single length of flexible material can alternatively comprise two or more pieces that are stitched, glued, or otherwise attached to one another. In various embodiments, the length of elongated member 413 from first end 411 to attachment 415 may range from 1 inch to greater than 17 inches. In certain other embodiments, the length of elongated member 413 from first end 411 to attachment 415 is from 1 to 18 inches. Elongated member 413 has an enlarged first end 411 that is wider than the elongated member, and a second end 417 that is attached to arms 422*a* and 422*b*.

The exercise devices 100, 400 of FIGS. 1-4 are used in a single configuration. A single anchor 110, 410 that is suitable for attachment to a single type of structure (i.e., between a door and a door jamb) is affixed to the device 100, 400, along with a single type of grip 123, 423. Further, while the length of various portions of the device 100, 400 may be adjusted within a predetermined range (which is limited, for example, by the overall length(s) of the strap(s)), the device 100, 400 is limited to a single configuration and the length cannot be adjusted indefinitely.

Figure 5:
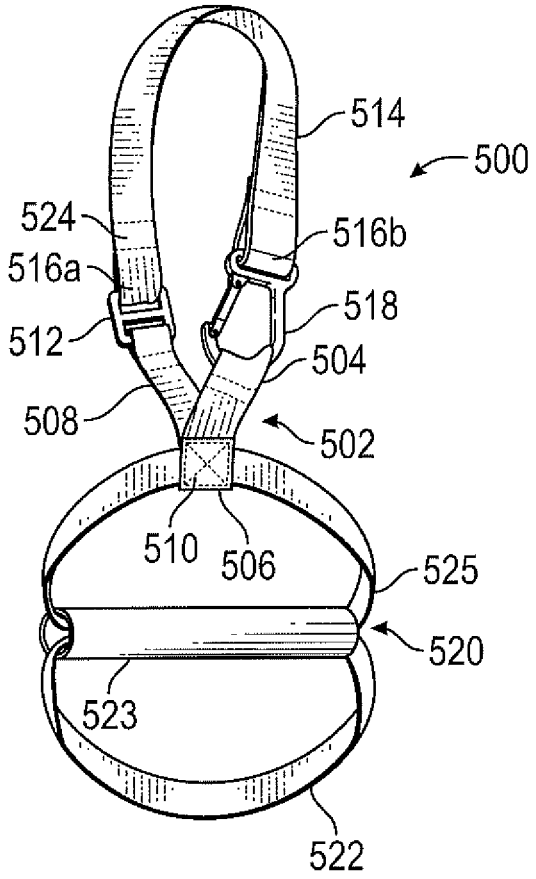
FIG. 5 is a perspective view of a hand grip assembly including a first embodiment of an infinity loop.

FIG. 5 is a perspective view of a handgrip assembly 500 suitable for use in an embodiment of a modular exercise device. Additionally, two handgrip assemblies 500 may each be attached to a structure at a separate point (i.e., using a separate anchor or attachment point), permitting a user to perform exercises such as pull ups, dips, and muscle ups more easily than is possible with an exercise device such as exercise device 400 which employs a single anchor 100, 410.

In an embodiment, the handgrip assembly comprises a combination grip 520 comprising a tubular hand grip 523, a foot grip 522, and a supporting member 525. In other embodiment, alternative grips, such as grip 123, grip 423, or other configurations of hand grips, foot grips, or finger grips, may also be used in place of combination handgrip 520.

In an embodiment, the hand grip assembly further comprises a member 514 with a respective one of a pair of loops 516*a*, 516*b* at either end. In an embodiment, the first loop 516*a* is movably connected to a lengthening mechanism 512 and the second loop 516*b* is connected to a strap attachment mechanism 518. As shown, by way of example and not limitation, the lengthening mechanism 512 may be a buckle and the strap attachment mechanism 518 may be a carabiner. A strap restraint 524 may secure the free end of the strap 514 proximate to the first loop 516*a*. In alternative embodiments, other combinations of lengthening mechanisms and strap attachment mechanisms are used (e.g., two lengthening mechanisms, two strap attachment mechanisms) or one or more of the loops 516*a*, 516*b* are left free.

The combination grip 520 is attached to the member 514 via a first embodiment of an infinity loop 502. As shown, the infinity loop 502 comprises a single member 510 formed into three distinct loops loop 504, loop 506, and loop 508. Loop 504 is configured to attach to strap attachment mechanism 518, while loop 508 is configured to attach to strap lengthening mechanism 512. Loop 506 is configured to support the configuration grip 520 via supporting member 525. In an embodiment, loop 506 serves as a frictional support for supporting member 525, which is movable through loop 506. In another embodiment, loop 506 is fixedly connected to supporting member 525.

In an embodiment, loop 506 is configured to constrain the supporting member 525 such that the supporting member 525 is angled away from a user's arm while the combination grip 520 is in use. As shown in FIG. 5, the supporting member 525 is constrained by the loop 506 such that the supporting member 525 is substantially parallel to a user's arm at the point where the supporting member 525 passes through the loop 506. This prevents the edges of the supporting member 525 from rubbing or chafing against the user's arm during exercises. As discussed above, in an embodiment, the supporting member 525 is fixedly attached to the loop 506 such that the supporting member 525 is held parallel to the loop. In an alternative embodiment, the supporting member is movably constrained by the loop 506. In an embodiment, the loop 506 is substantially inflexible. The loop 506 may incorporate an inflexible material, such as an external coating of rubber which prevents the loop from flexing, so as to ensure the supporting member 525 is held parallel to a user's forearm.

Figure 6:
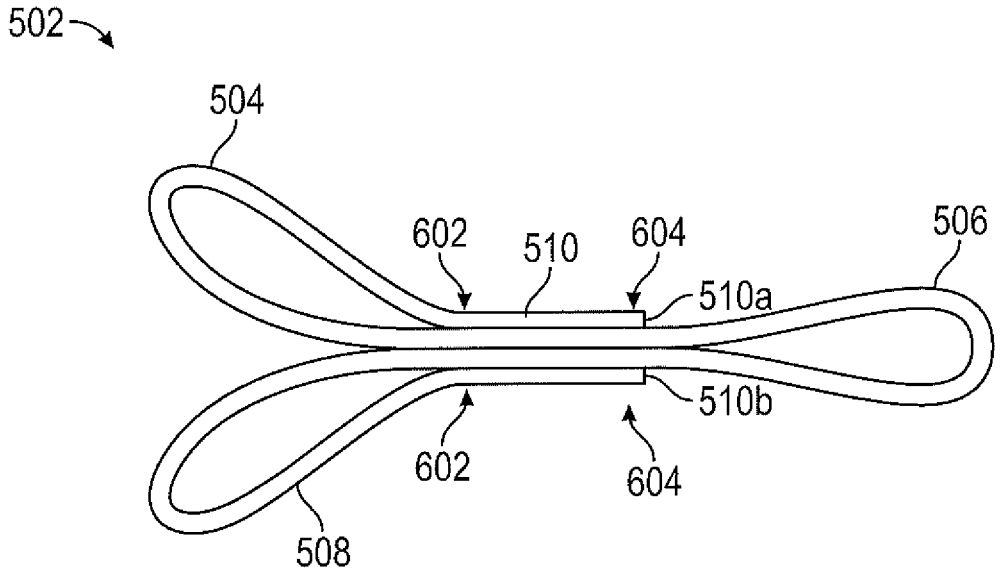
FIG. 6 is a side view of the infinity loop depicted in FIG. 5, with the other elements of the hand grip assembly omitted.

FIG. 6 provides a side view of infinity loop 502, with the other elements of the hand grip assembly 500 omitted. As shown, infinity loop 502 is formed from a single member 510. Member 510 is stacked by doubling member 510 against itself at each of loops 504, 506, and 510. A first portion of the member 510 proximate to an end 510*a* is folded against a second portion of the member 510, forming loop 504. A third portion of the member 510 is folded against the second portion of the member 510, forming loop 506. A fourth portion of the member 510 proximate end 510*b* is folded over the third portion of the member 510, forming loop 508. In this manner, a stack comprising four layers of the member 510 is formed.

The stacked portions of the member 510 may be secured together. In an embodiment, stitching is used to join the layers of the member 510 together along lines 602 and 604. In an embodiment, additional stitching may be used to connect the layers of the member 510 together in the area between lines 602 and 604. In an embodiment, the stitching along lines 602, 604 form parallel lines of stitching.

Figure 7:
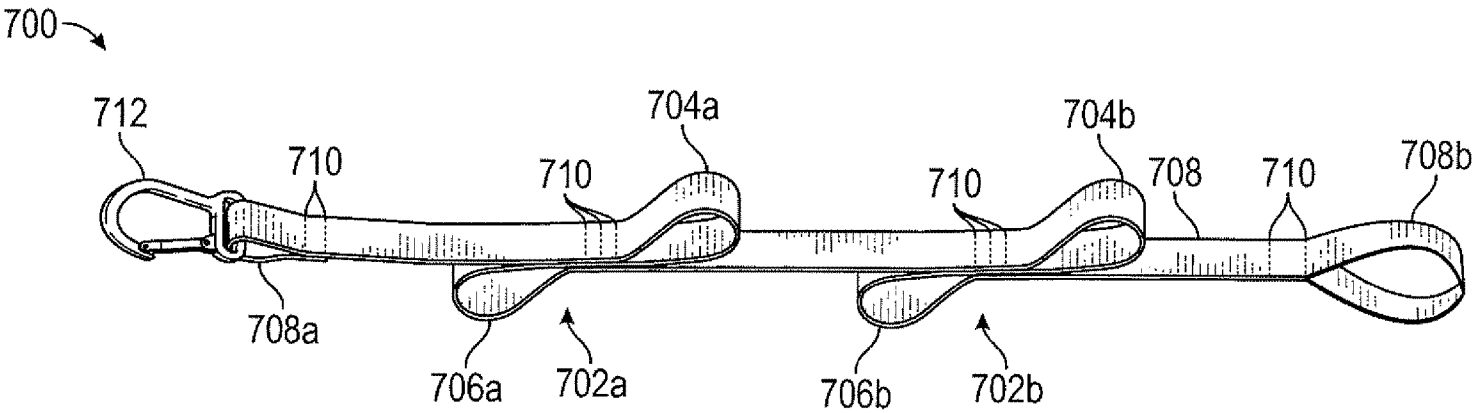
FIG. 7 is a perspective view of a strap including a second embodiment of an infinity loop.

FIG. 7 provides a perspective view of an embodiment of a strap 700 for use in a modular exercise device comprising two infinity loops 702*a* and 702*b*. As shown, the two infinity loops 702*a* and 702*b* are formed from a single elongated member 708. Each end of the elongated member comprises a loop 708*a*, 708*b*. In an embodiment, one or more of the loops 708*a*, 708*b* is connected to a strap attachment mechanism 712.

By providing multiple infinity loops 702*a* and 702*b* on a single strap 700, the strap 700 may be used with high anchor points by users of varying heights or by a single user to perform a wide variety of exercises (such as pull ups, dips, and muscle ups) without needing to adjust the strap 700. Instead, different attachment points on the strap 700 provided by the infinity loops 702*a*, 702*b* may be used in connection with a grip assembly.

Lines of stitching 710 are used to hold various portions of the elongated member 708 together, such as near the loops 708*a*, 708*b* where the elongated member 708 doubles back on itself. Similarly, three lines of stitching are used to form each of the infinity loops 702*a*, 702*b*. In an embodiment, one or two lines of stitching are used. In an alternative embodiment, four or more lines of stitching are used. As discussed herein, in other embodiments, other mechanisms are used to hold portions of the elongated member 708 together so as to form the loops 708*a*, 708*b* and the infinity loops 702*a*, 702*b*.

Each infinity loop 702*a*, 702*b* comprises a pair of opposite component loops. As shown, infinity loop 702*a* is formed from component loops 704*a*, 706*a* and infinity loop 702*b* is formed from component loops 704*b*, 706*b*. Each of the component loops 704*a*, 704*b*, 706*a*, 706*b* may be attached to a strap attachment mechanism so as to attach a grip, another strap, or another component of a modular exercise device. In an embodiment, the elongated member is wrapped around a support structure proximate loop 708*a* and strap attachment mechanism 712 is secured to component loop 706*a*. In this manner, the strap 700 is secured to the support structure and may be used to perform various exercises. In various embodiments, grips (such as, for example, combination grip 520) are attached to one or more of the component loops 704*a*, 704*b*, 706*a*, 706*b* or loops 708*a*, 708*b*. In an embodiment, a strap length adjustment mechanism is operatively connected to the strap 700 so as to permit a user to adjust the distance between the infinity loops 704, 706 or between the ends of the strap 700.

In an embodiment, attachments to component loops 704*a*, 704*b*, 706*a*, 706*b* are secured so as to direct force towards the opposite end. In other words, in an embodiment, if a grip is attached to component loop 704*a* or 704*b*, loop 708*a* is secured to a support. Similarly, if a grip is attached to component loop 706*a* or 706*b*, loop 708*b* is secured to a support. In this way, the strength of the strap 700 is maximized and the force on the stitching 710 is minimized. In an alternative embodiment, grips may be attached to component loops 704*a*, 704*b*, 706*a*, 706*b* regardless of whether loop 708*a* or 708*b* is secured to a support, increasing the versatility of the strap 700 and enabling its use in connection with a wide variety of exercises.

Figure 8:
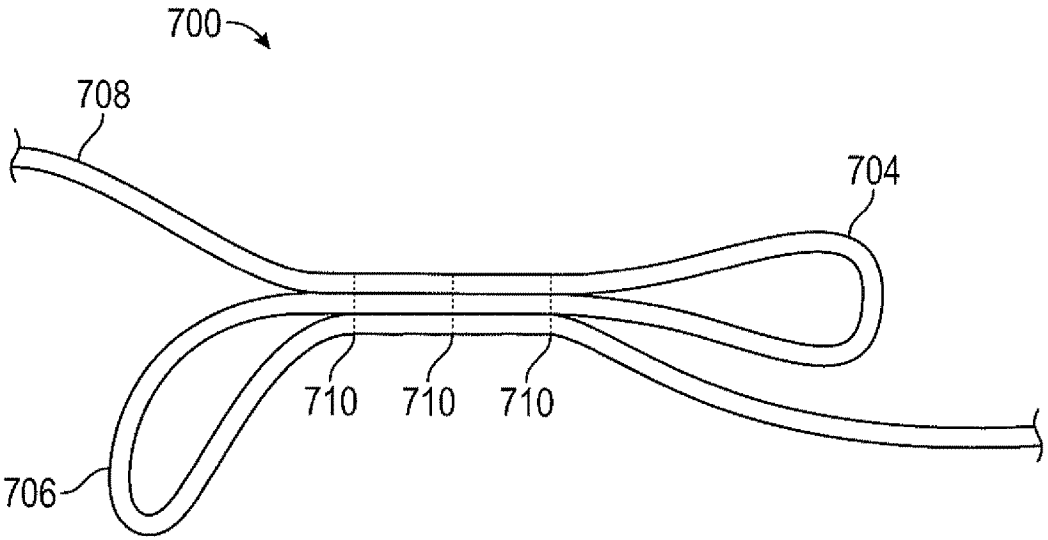
FIG. 8 is a cross-sectional view of the infinity loop depicted in FIG. 7.

FIG. 8 provides a side view of infinity loop 702, with the other elements of the strap 700 omitted. As shown, infinity loop 702 is formed from a single member 708. Member 708 is stacked by doubling member 708 against itself at each of loops 704 and 706. The stacked portions of the member 708 may be joined together. In an embodiment, parallel lines of stitching 710 are used to join the layers of the member 708 together.

Figure 9:
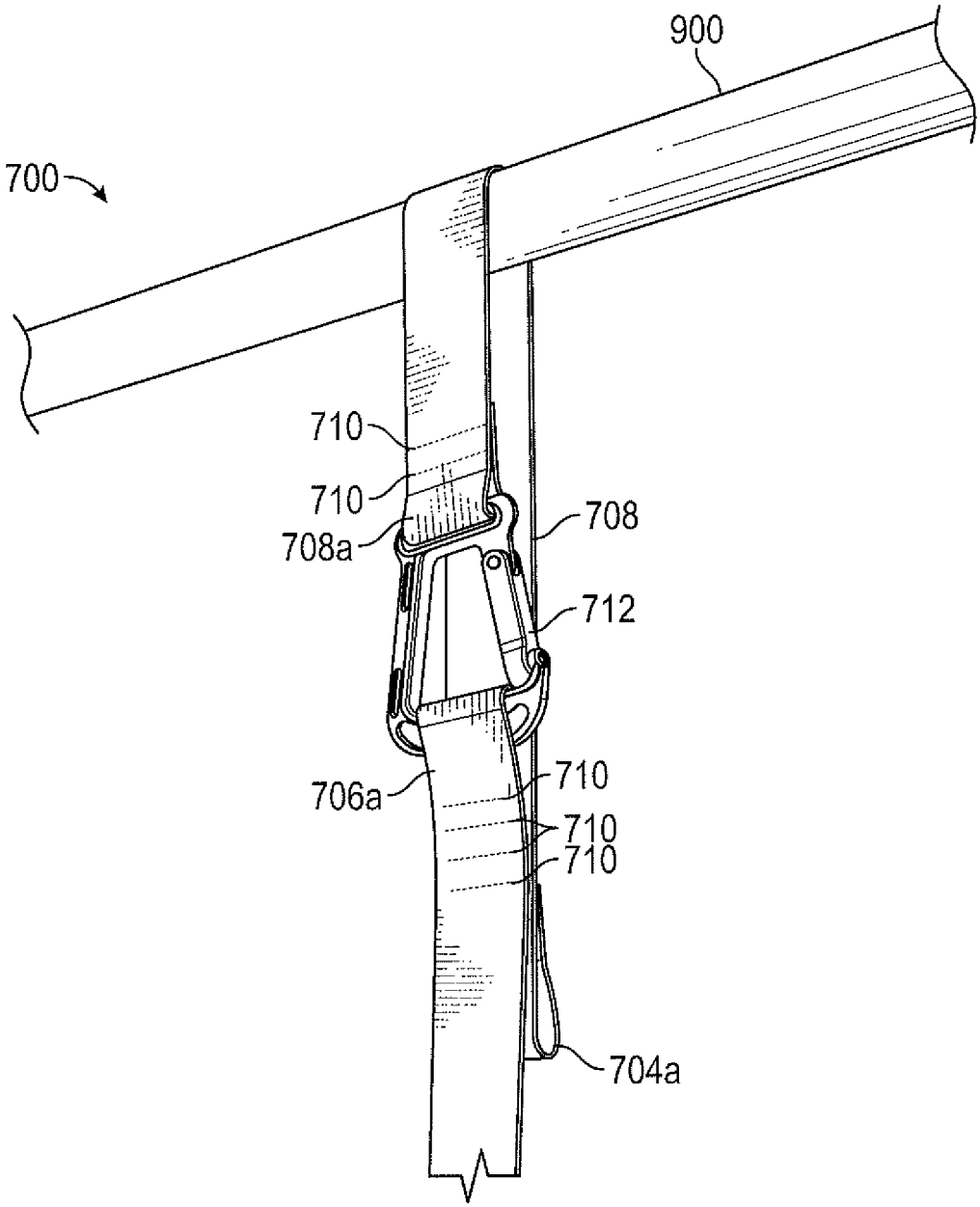
FIG. 9 is a perspective view of a strap including an embodiment of an infinity loop attached to a horizontal bar.

FIG. 9 provides a perspective view of an embodiment of strap 700 secured to a support structure 900. As shown, the elongated member 708 is wrapped around the support structure 900 proximate loop 708*a*. Strap attachment mechanism 712 is secured to component loop 706*a*, forming a closed loop about the support structure 900. In this manner, the strap 700 is secured to the support structure 900 and may be used to perform various exercises.

Figure 10:
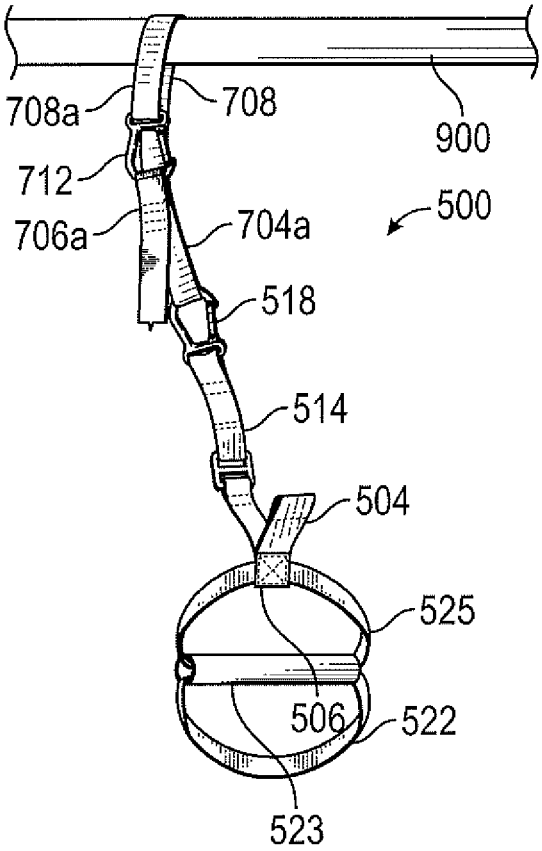
FIG. 10 is a perspective view of the strap of FIG. 9 with a handgrip attached to the infinity loop.

FIG. 10 provides a perspective view of an embodiment of strap 700 secured to a support structure 900 and combination grip 500. As shown, combination grip 500 is attached to component loop 704*a* using strap attachment mechanism 518, while strap 700 is secured to the support structure 900.

Figure 11:
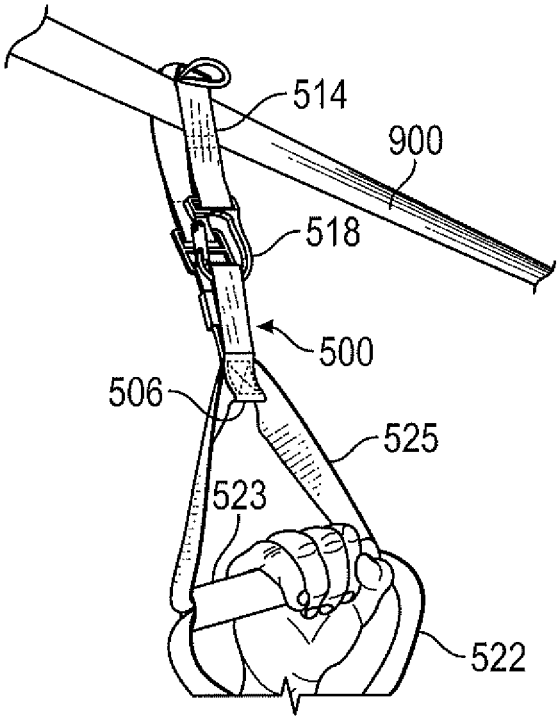
FIG. 11 is a perspective image of a handgrip with an infinity loop attached to a horizontal bar.

FIG. 11 provides a perspective view of an embodiment of combination grip 500 secured directly to a support structure 900. As shown, member 514 passes over the structure and strap attachment mechanism 518 is secured to loop 508.

In an embodiment, a kit is provided for modularly assembling an exercise device. The kit may include one or more combination grips 500 and straps 700. A user may perform various exercises by either connecting one or more of the combination grips 500 to a support structure 900 directly or by connecting one or more of straps 700 to the support structure 900, and connecting one or more of the combination grips 500 to the straps 700. By way of example, a single strap 700 may be connected to a first combination grip 500 via loop 706 a and a second combination grip 500 via loop 706*b*. One or more strap length adjustment mechanisms 135 and/or strap attachment mechanisms 518 may be provided in the kit to facilitate flexibility in assembling various permutations of components in the kit. Other configurations of the kit will be clear to one of skill in the art based on the present disclosure.

FIG. 12 provides a perspective view of an embodiment of a pair of straps 700, each secured to a support structure 900 and one of a respective pair of combination grips 500. This configuration enables a user to perform a variety of fully suspended exercises, such as pull ups, dips, and muscle ups. The use of two separate straps 700, each with a different anchor point on the support structure 900, permits a user to vary the distance between the combination grips 500 and the angle of the straps 700. Further, a user can easily move the straps 700 along the structure 900 to select a different anchor point, simply by sliding the straps 700.

One of skill in the art will recognize that all the various components identified in this disclosure may be made from any material or combination of materials suitable for the expected structural load and environment, without limitation—metals, composites, engineered plastics, natural or synthetic materials, etc.

Furthermore, while the particular preferred embodiments have been shown and described, it is obvious to those skilled in the art that changes and modifications may be made without departing from the teaching of the disclosure. The matter set forth in the foregoing description and accompanying drawings is offered by way of illustration only and not as limitation. The actual scope of the disclosure is intended to be defined in the following claims when viewed in their proper perspective, based on the related art.

What is claimed is:

1. A method for configuring and using an exercise device, wherein the exercise device comprises an elongated member having a pair of ends separated by a length, a first loop formed by folding a first portion of said elongated member against a second portion of said elongated member, wherein said second portion of said elongated member is proximate said first portion of said elongated member, and a second loop formed by folding a third portion of said elongated member against said second portion of said elongated member, wherein the third portion of said elongated member is proximate said second portion of said elongated member, said second loop is proximate said first loop, and said second portion of said elongated member is secured to said first portion of said elongated member and said third portion of said elongated member, wherein the first end of the elongated member includes a strap attachment mechanism and the second end of the elongated member includes a grip, the method comprising:

securing the elongated member to a structure by wrapping the first end of the elongated member around the structure and removably attaching the strap attachment mechanism to the second loop; and performing an exercise by applying force to the grip.

2. The method of claim 1, wherein the exercise device further comprises on the elongated member between the pair of ends at a distance between the second loop and the second end, a third loop formed by folding a fourth portion of said elongated member against a fifth portion of said elongated member, wherein said fifth portion of said elongated member is proximate said fourth portion of said elongated member, and a fourth loop formed by folding a sixth portion of said elongated member against said fifth portion of said elongated member, wherein the sixth portion of said elongated member is proximate said fifth portion of said elongated member, said fourth loop is proximate said third loop, and said fifth portion of said elongated member is secured to said fourth portion of said elongated member and said sixth portion of said elongated member, the method comprising:

decreasing the distance between the grip and the structure by removing the strap attachment mechanism from the second loop second and removably attaching the strap attachment mechanism to the fourth loop.

3. The method of claim 1, wherein the exercise device further comprises on the elongated member between the pair of ends at a distance between the second loop and the second end, a third loop formed by folding a fourth portion of said elongated member against a fifth portion of said elongated member, wherein said fifth portion of said elongated member is proximate said fourth portion of said elongated member, and a fourth loop formed by folding a sixth portion of said elongated member against said fifth portion of said elongated member, wherein the sixth portion of said elongated member is proximate said fifth portion of said elongated member, said fourth loop is proximate said third loop, and said fifth portion of said elongated member is secured to said fourth portion of said elongated member and said sixth portion of said elongated member and wherein the grip is removably attached to the first end, the method comprising:

decreasing the distance between the grip and the structure by removing the grip from second end and removably attaching the grip to either of the first or third loop.

4. An exercise device comprising:

an elongated member having a pair of ends separated by a length, a first loop formed by folding a first portion of said elongated member against a second portion of said elongated member, wherein said second portion of said elongated member is proximate said first portion of said elongated member, a second loop formed by folding a third portion of said elongated member against said second portion of said elongated member, wherein the third portion of said elongated member is proximate said second portion of said elongated member and said second loop is proximate said first loop, wherein said second portion of said elongated member is secured to said first portion of said elongated member and said third portion of said elongated member, wherein said first portion of said elongated member is proximate a first end of said pair of ends, a fourth portion of said elongated member proximate a second end of said pair of ends and said third portion of said elongated member, and a third loop formed by folding said fourth portion of said elongated member against said third portion of said elongated member, wherein said third loop is proximate said second loop, wherein said fourth portion of said elongated member is secured to said third portion of said elongated member, an attachment mechanism secured to said first loop, and a grip secured to said second loop by a supporting member.

5. The exercise device of claim 4, wherein said grip is a hand grip assembly with a tubular hand grip and a foot grip secured to said hand grip, and said supporting member and said foot grip each pass through said tubular hand grip.

6. The exercise device of claim 5, wherein said supporting member is movable through said second loop.

7. The inelastic exercise device of claim 5, wherein said supporting member is immovably secured to said second loop.

8. The exercise device of claim 5, further comprising:

a second strap comprising a first strap end, a second strap end, and a strap restraint configured to constrain said second strap end proximate said second strap forming an open loop, wherein said first strap end comprises a closed loop, and wherein said open loop is operatively connected to a strap lengthening mechanism connected to the third loop such that a distance between said strap lengthening mechanism and said first strap end is adjustable by moving said second strap through said strap lengthening mechanism.

9. The exercise device of claim 8, wherein said closed loop is removably connected to said attachment mechanism so as to secure said exercise device to a structure.

10. The exercise device of claim 9, wherein said pair of ends further comprises a second end comprising a fourth loop.

11. A kit for assembling an exercise device, the kit comprising:

an elongated member having a pair of ends separated by a length, the elongated member comprising:

a first loop formed by folding a first portion of said elongated member against a second portion of said elongated member, wherein said second portion of said elongated member is proximate said first portion of said elongated member; and a second loop formed by folding a third portion of said elongated member against said second portion of said elongated member, wherein the third portion of said elongated member is proximate said second portion of said elongated member and said second loop is proximate said first loop;

wherein said second portion of said elongated member is secured to said first portion of said elongated member and said third portion of said elongated member;

a grip assembly comprising: a first strap;

a hand grip attached to the first strap; and a second strap adjustably connected to the first strap;

a first attachment mechanism configured to removably secure said first loop to said second strap; and a second attachment mechanism configured to removably secure said second loop to a structure so as to support said elongated member.

* * * * *